United States Patent [19]

Toal et al.

[11] Patent Number: 4,958,399

[45] Date of Patent: Sep. 25, 1990

[54] TROWEL ASSEMBLY

[75] Inventors: Hugh F. Toal, Jackson; Nicholas J. Careyote, Bordentown, both of N.J.; Michael A. Sapienza, Yardley, Pa.

[73] Assignee: Congoleum Corporation, Lawrenceville, N.J.

[21] Appl. No.: 367,200

[22] Filed: Jun. 16, 1989

[51] Int. Cl.[5] ..... B05C 11/04; B05C 17/10

[52] U.S. Cl. ..... 15/104 S; 15/145; 15/235.4; 403/353

[58] Field of Search ..... 15/176.1, 176.6, 104 S, 15/235.4, 235.5, 235.6, 235.8; 51/393; 81/485, 489; 16/114 R; 403/353, 407.1

[56] References Cited

U.S. PATENT DOCUMENTS

| | | | |
|---|---|---|---|
| 1,168,648 | 1/1916 | Johnson . | |
| 2,278,803 | 4/1942 | Stabbert | 72/136 |
| 2,395,186 | 2/1946 | Jones | 72/136 |
| 2,662,454 | 2/1953 | Whiteman | 94/45 |
| 3,166,776 | 1/1965 | Selck | 15/235.6 |
| 3,346,905 | 10/1967 | Scarpelli | 15/235.6 |
| 3,916,472 | 11/1975 | Carder | 15/235.6 |
| 4,194,852 | 3/1980 | Cupp et al. | 15/145 |
| 4,724,572 | 2/1988 | Gringer | 15/235.4 |

*Primary Examiner*—Edward L. Roberts

*Attorney, Agent, or Firm*—Alexis Barron; Albert L. Free

[57] ABSTRACT

A trowel suitable for spreading underlayment onto a floor and for later spreading an adhesive layer over the hardened underlayment. It makes use of a rail on one side of which the handle is mounted and on the other side of which the blade is mounted. The blade is of a spring metal, and the rail is in the form of a U-shaped channel member secured to the central portion of the blade. The rail is wider than the handle, and covers about 87% of the length and about 60% of the width of the blade, to stiffen the blade while leaving its edges somewhat flexible. The rail is also provided with flange on each side of the channel portion, and the flanges each contain openings for receiving spring clips bent up from the blade, so that the blade can be easily mounted to and demounted from the rail. Punched-up detents on the blade cooperate with bent-down ends of the channel to hold the blade in position on the rail while permitting its easy release for cleaning or replacement.

9 Claims, 4 Drawing Sheets

FIG. 1
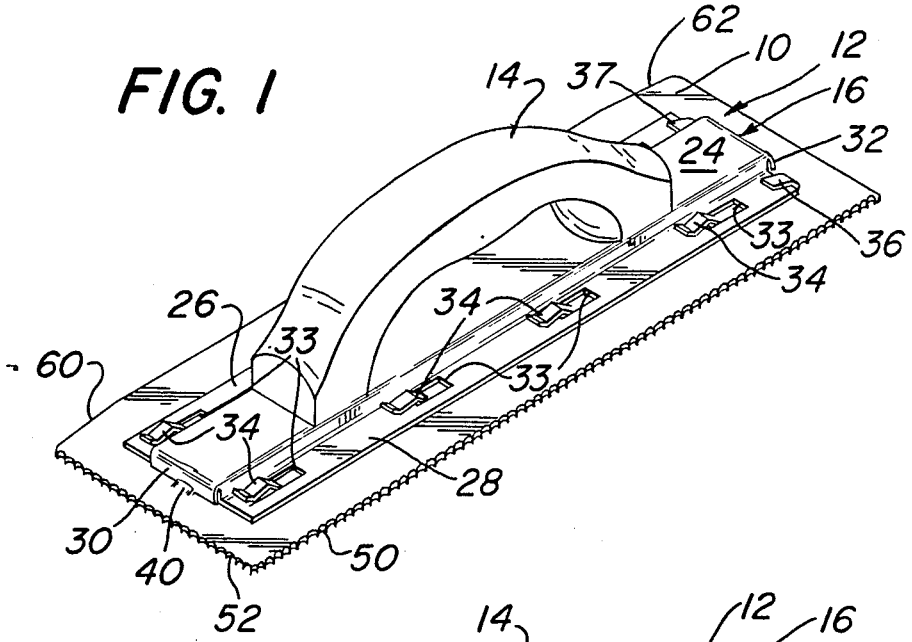
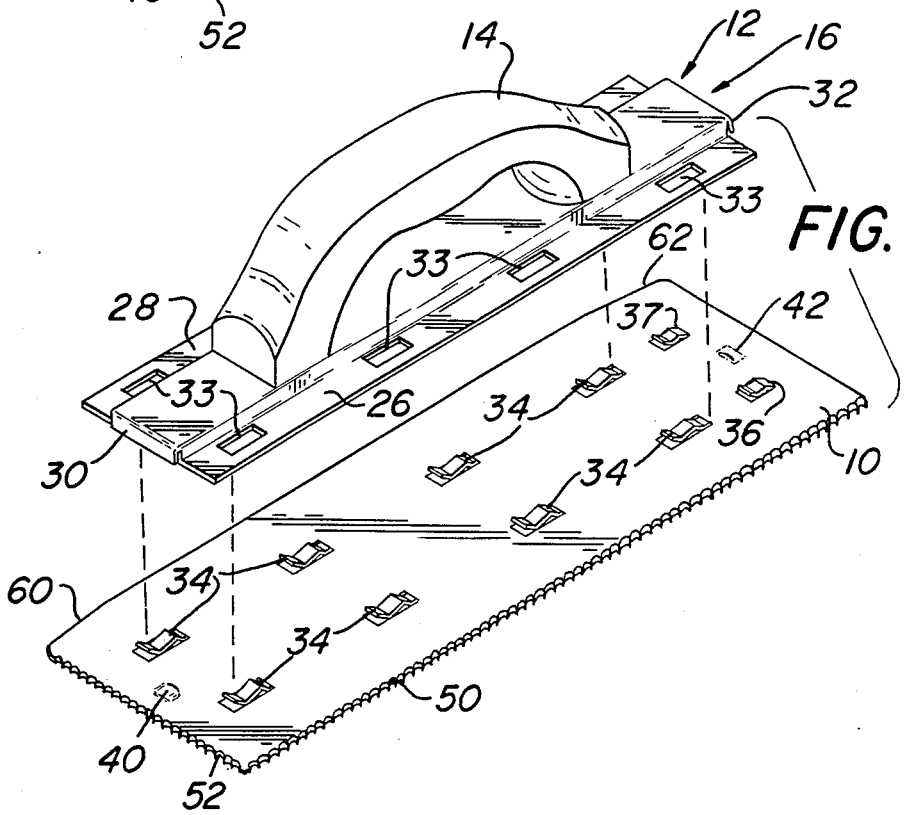
FIG. 2

TROWEL ASSEMBLY

FIELD OF THE INVENTION

This invention relates to trowel assemblies comprising a blade and a blade holder, and particularly to such assemblies in which the blade is removable from, and replaceable onto, the holder.

BACKGROUND OF THE INVENTION

Trowels are known which are useful for spreading flowable material into a flat sheet-like layer. Such operation is desirable, for example, in spreading underlayment onto a floor having surface irregularities so that the irregularities are filled and the top of the spread layer is substantially flat to receive an overlying floor covering in sheet or tile form. When the underlayment has been smoothed and permitted to harden, a layer of adhesive is usually applied over it and smoothed with a trowel; the floor covering is then laid over the adhesive, which upon hardening cements the floor covering to the underlayment layer.

In its simplest form, a conventional trowel comprises a handle and a flat blade to one side of which the handle is directly attached; the edge of the blade may be used to move around masses of the flowable material for general positioning of it, and the flat surface opposite the handle may be held more or less flat against the top of the layer of flowable material and moved about in lateral directions to effect smoothing of its exposed surface.

It is known to provide, along one or more edges of the trowel plate, one or more rows of serrations, so that by pressing such an edge downward through the flowable material to the substrate on which it rests, and then dragging the blade horizontally in a direction at right angles to the row of serrations, a multi-ridged layer of flowable material is formed having a uniform maximum thickness equal to the depth of the serrations. By thereafter dragging a plain edge of the blade across the ridges, a smooth uniform layer can be obtained.

Trowels are also known in which the blade holder comprises a rail extending along one face of the blade, to which rail a handle is secured or with which the handle is integral. In some cases the rail extends laterally beyond the handle grip, and it is also known to use a stiffening plate between handle and blade, which plate extends not only longitudinally but also laterally beyond the handle.

In addition, trowels are known in which the blade can be removed for cleaning or exchange, and the same or a new blade re-mounted on the blade holder. In some cases this has been accomplished by providing a mortise on the underside of the rail and a tenon on top of the blade so that the two can be joined or taken apart by a mutual sliding action. This of course requires that a special blade-and-tenon structure be provided.

It is also known to provide the blade with a longitudinal row of keyhole-shaped openings, and to provide a corresponding row of headed bolts on the underside of the rail, the heads fitting through the larger parts of the keyhole but being trapped when the stems of the screws are slid into the smaller parts of the keyholes, after which a screw is tightened to mount the blade tightly on the handle, as shown in U.S. Pat. No. 3,916,472 of W. E. Carder, filed Jan. 29, 1974 and issued Nov. 4, 1975. Such an arrangement, however, uses a complex array of screws, requires a special tightening step, and locates screw heads on the exposed side of the plate where they can interfere with the smoothing action.

While these various types of trowels are useful for many purposes, they leave something to be desired with respect to one or more of the characteristics of ease of removal and installation of the blade, simplicity of construction of those parts involved in such removal and installation, the degree and distribution of stiffness and flexibility of the blade, and smoothness of the levelling action.

Accordingly, an object of this invention is to provide a new and useful trowel assembly.

Another object is to provide such a trowel assembly in which the blade is especially easily removed from and attached to the blade holder, using a simple, inexpensive but reliable construction to accomplish this.

A further object is to provide such a trowel in which the distribution of stiffness and flexibility is especially well adapted to spreading a flat layer of flowable material over a substrate having irregularities in its surface.

A still further object is to provide such a trowel in which the tendency of the trowel to produce swirls in the material being spread by the trowel is mitigated.

SUMMARY OF THE INVENTION

These and other objects of the invention are achieved by the provision of a trowel assembly comprising a blade and a blade holder, the blade holder comprising a rail portion having a two-dimensional array of openings therein for receiving a corresponding, congruent, two-dimensional array of punched-up clips on the central area of the blade, such that by aligning the blade and rail and moving them relatively along the longitudinal direction, the spring clips enter the rail openings and then grasp the rail itself. Detents are provided to hold the rail and blade against longitudinal motion once thus assembled to each other, from which detents the blade and rail can be freed by a slight separating motion when disassembly is desired.

The rail is of a rigid configuration, and preferably substantially wider than the handle but narrower than the blade, and preferably the blade has physical characteristics to provide the preferred stiffness near its center and flexibility near its edges. In a preferred embodiment the blade is rectangular and of a spring metal and has serrations along at least one edge, and the rail is centered on the blade and covers from about 50% to 90% of the width and 50% to 90% of the length of the blade, preferably about 60% of the width and about 87% of the length. The rail preferably comprises longitudinal axial channel, with flanges on each side thereof which contain the array of openings for receiving the spring clips.

As a further preferred feature, one longitudinal edge of the blade is free of serrations, and is bevelled near its ends to minimize the creation of swirls in the flowable material being smoothed by the trowel.

BRIEF DESCRIPTION OF FIGURES

These and other objects and features of the invention will be more readily understood from a consideration of the following detailed description, taken in connection with the accompanying drawings, in which:

FIG. 1 is a trowel assembly as seen from above;

FIG. 2 is an exploded view corresponding to FIG. 1, with the blade and blade holder vertically separated from each other;

DETAILED DESCRIPTION OF SPECIFIC EMBODIMENTS

Figure 3:
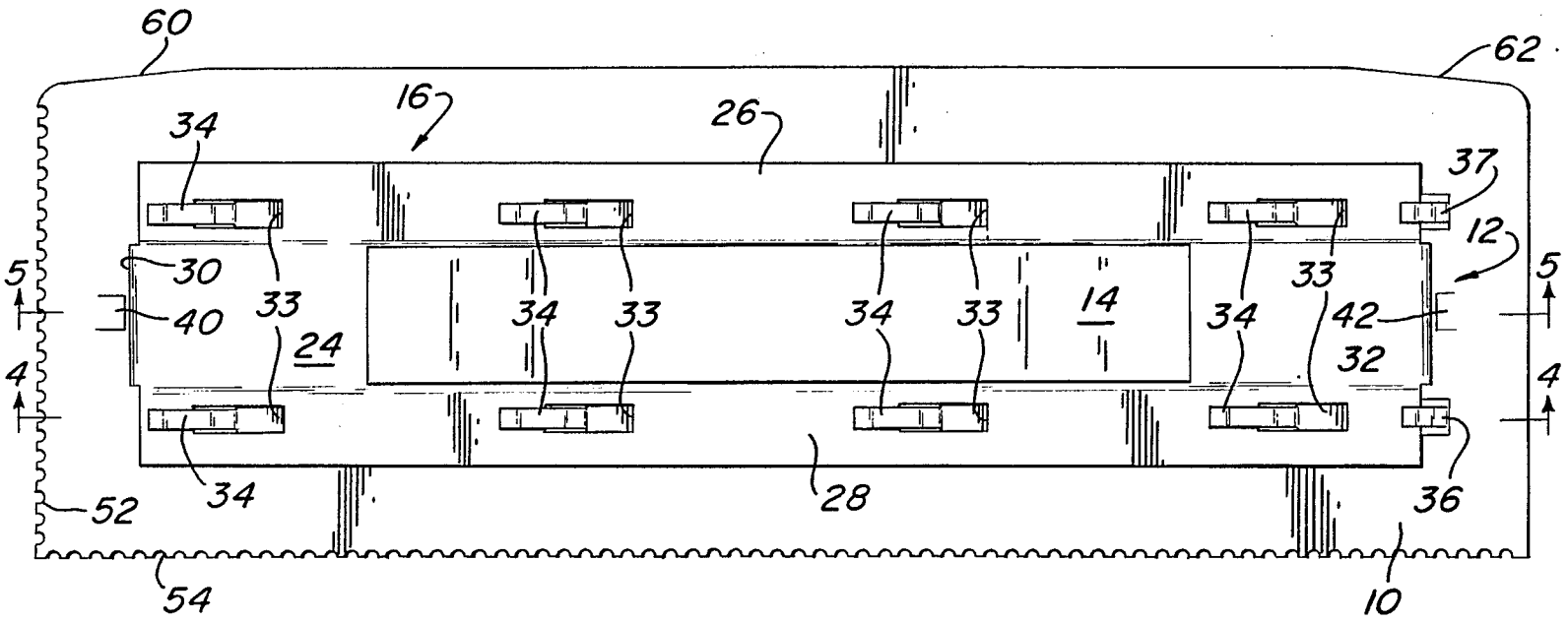
FIG. 3 is a top plan view of the trowel assembly of the invention showing it in use with a levelling blade.
Figure 4:
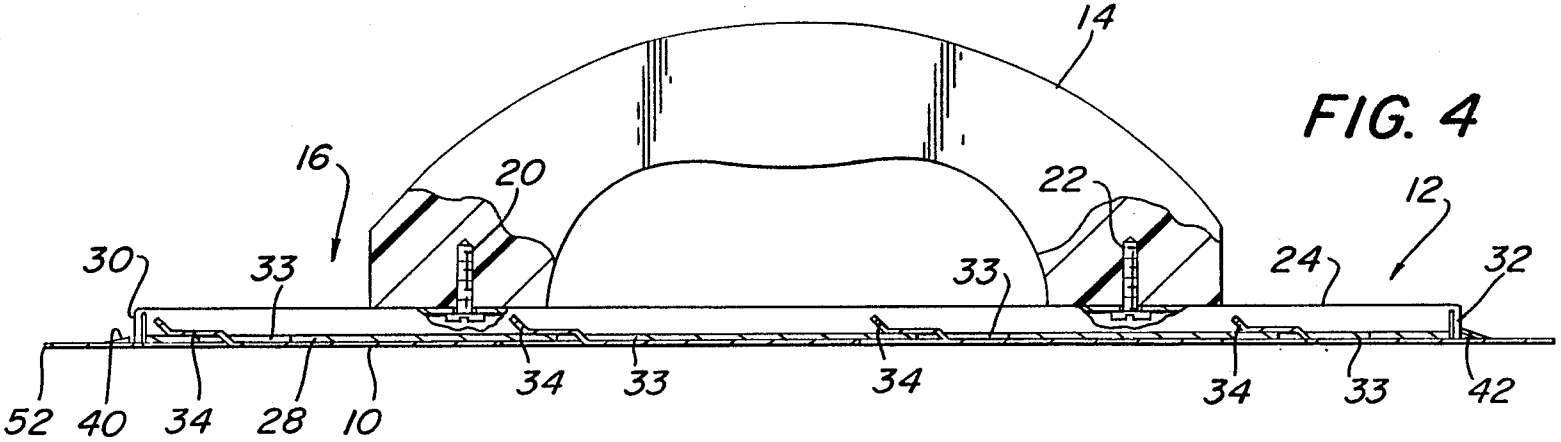
FIG. 4 is a side elevational view of the trowel assembly of the invention, with parts broken away.
Figure 5:
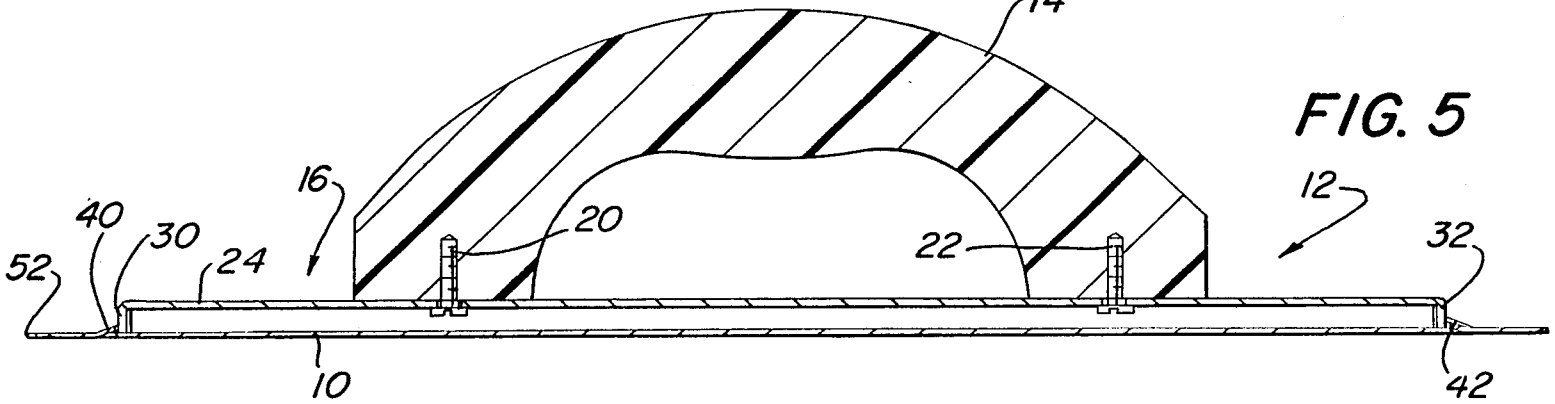
FIG. 5 is a vertical sectional view of the trowel assembly of the invention as shown in FIG. 4, taken through the handles.

Referring now to the specific embodiment of the invention as shown in the drawings by way of example only, and without thereby in any way limiting the scope of the invention, the trowel assembly comprises a blade 10 and a blade holder 12 made up of a handle 14 and a rail 16. The handle is in the usual shape of a manual grip, and is secured to the rail by a pair of screws 20 and 22 (see FIG. 4) extending upwardly from the lower side of the rail into the end regions of the handle. The rail has a shape comprising a central, longitudinally-extending, rectangular channel 24 and a pair of flanged portions 26 and 28 on each side of the channel. The heads of the screws 20 and 22 are positioned within the channel so as not to interfere with assembly of the blade to the handle portion.

In this specific example, the rail 16 is made up of a single bent piece of metal which provides the channel 24 and the lateral flanges 26 and 28, the ends 30 and 32 of the channel being bent downwardly to close the ends of the channel and, in this embodiment, to serve as abutments for the detents to be described later. The shape and dimensions of the rail provide the desired degree of rigidity to the central portion of the blade.

Each of the lateral flanges 26 and 28 contains four longitudinally spaced-apart rectangular openings such as 33, while the blade 10 carries a corresponding congruent, two-dimensional array of punched-up clip members such as 34 adapted to fit within the openings in the flanges described above so that when the rail is then moved to the right in FIG. 2, the clips grasp the adjacent portion of the rail and hold it securely to the blade. Also provided in this example is an additional pair of bent-up spring clips 26 and 37 into which the ends of the flanges of the rail extend.

Adjacent the opposite ends of the array of bent-up clips on the blade 10 are a pair of punched-up detents 40 and 42. Detent 42 is positioned so that when the rail is slid into the spring clips as described above, the leading edge of the blade will abut against the inner side of the latter detent before its motion can be arrested by the spring clips themselves, the latter abutment therefore providing a positive stop and protecting the clips from damage when inserting the blade. With the blade and rail in this position, the other end of the rail will automatically drop behind the inner side of the other detent 40 to lock the blade releasably in place, the bent-down end portions 30,32 of the channel 24 serving as the abutments for both of the above-described detents. To remove the blade from the rail, one need merely apply sufficient separating motion between the front ends of the blade and the rail to raise the front end of channel member 24 above detent 40, and then slide the rail and blade apart from each other.

The blade preferably contains serrations on at least one of its edges, and in this example contains such serrations 50, 52 along one longitudinal edge and along one lateral edge; the depths of the serrations are selected to control the depth of the ridged layer produced by moving the serrated edge along through the composition or material to be spread.

The non-serrated longitudinal edge of the blade is beveled at its ends 60 and 62 to avoid the presence of sharp corners. It has been found that a sharp corner tends to produce swirls in the material being spread, and the above-described bevelling greatly reduces such undesired swirls.

In the preferred form of the trowel assembly, the components are made so that the blade has a requisite amount of stiffness, especially in its more central regions, and yet has a sufficient degree of peripheral flexibility to permit the blade to conform to a certain amount of irregularity in the substrate to which the material is being layered. To this end, I prefer to utilize a levelling blade having dimensions and a composition as follows:

Blade Dimensions—about 13 inches long by about 4.5 inches wide by 0.010 to 0.30 inches (preferably about 0.018 inches) in thickness.

Blade Material—AISI #1075 non-resulphurized carbon spring steel;

Rail Dimensions—Channel about 11½ inches long by about 1⅜ inches wide, total width including flanges, about 2.5 inches;

Rail Material—about 0.050 inch type 302 stainless steel.

Figure 6:
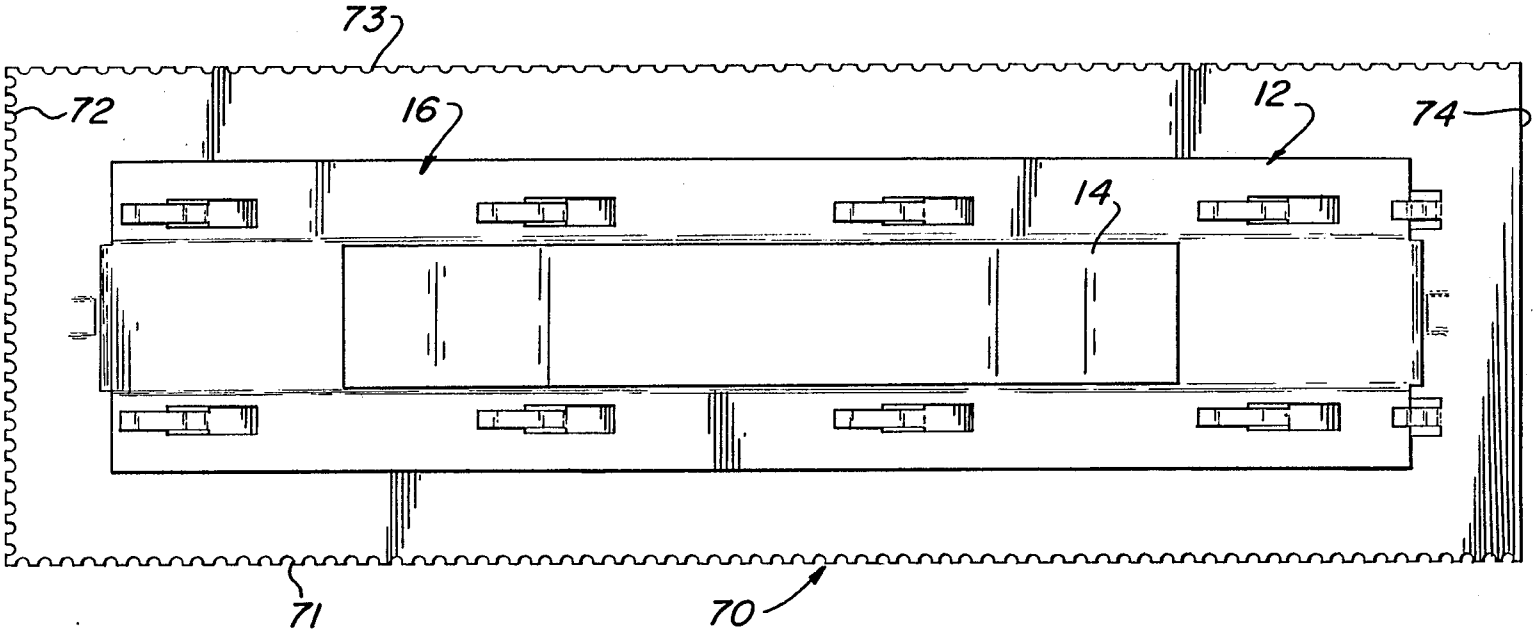
FIG. 6 is a top plan view of the trowel assembly showing it in use with an adhesive-applying blade.

In use, the blade is assembled to the rail in the manner described above, involving alignment of the spring clip array with the array of openings in the flanges of the rail, followed by longitudinal relative motion of the two elements until the leading edge of the blade is stopped by detent 42 to lock the blade in place between the detents 40 and 42. The assembly can then be used to spread material on a substrate in a uniform layer, dragging the serrated edge of the blade through the material at an angle of near 70° to the horizontal to form a ridged layer having a depth about the depth of the serrations; then the non-serrated edge may be used to spread the material in gross and then to smooth the ridges formed by the serrated edge, by dragging the straight edge over the ridges at about a 10° angle to the horizontal, thereby providing a smooth, top surface for the layer. When the work is done, the blade can be disassembled from the rail by raising the front end of the rail slightly from the blade to release the rail from the front detent 40, and then providing relative longitudinal separating motion between blade and rail until release is obtained. The blade can then be cleaned and later replaced, or a different blade can be assembled to the rail as desired. For example, the adhesive-applying blade 70 of FIG. 6 can then replace the levelling blade by assembling it to the rail as described above for the levelling blade, and then used to spread and smooth the adhesive layer prior to laying of the floor covering. In this case the edges 71, 72 and 73 may be serrated and edge 74 not serrated.

It is noted that, not only does the trowel assembly have the above-described features of advantageous stiffness, edge flexibility, operation and assembly, but it is also very simple and inexpensive to make. The blade is a single piece from which the spring clips are merely punched-up at intervals, as are the detents; the rail is a single piece of bent metal, in this preferred embodiment formed into a strong channel with lateral flanges containing openings for the blade edges and with the ends of the channels bent downward to serve as detent abutments. Accordingly an extremely simple, easy to make and use, economical unit has been provided which delivers superior performance for its intended purposes.

While the invention has been described with particular reference to specific embodiments in the interest of complete definiteness, it will be understood that it may be embodied in a variety of forms diverse from those specifically shown and described without departing from the spirit and scope of the invention as defined by the appended claims.

What is claimed is:

1. A trowel assembly, comprising a blade and a blade holder having a handle portion and a rail portion securing said handle to said blade, wherein:

said rail is wider than said handle portion but narrower than said blade, and is provided with a two-dimensional array of spring-clip receiving openings;

said blade is of a resilient material and provided with an array of punched-up spring clips congruent with said array of openings whereby said array of springs and said array of clips may be aligned so that said clips extend through said openings, and said blade and rail are slidable relatively to each other along a predetermined direction to cause said clips to grasp said blade and secure it to said rail; and detent means acting between said blade and said rail to hold said blade against disengagement of said clips from said blade during normal use but releasable by application of a separating force to permit slidable removal of said blade from said rail.

2. The trowel assembly of claim 1, wherein said blade is of spring steel about 10–30 mils in thickness, and said rail, when said blade is assembled to it, covers about 50% to about 90% of the width and about 50% to about 90% of the length of the blade.

3. The trowel assembly of claim 1, wherein said blade has at least one serrated edge and one non-serrated edge.

4. The trowel assembly of claim 1, wherein said detent means comprises a pair of punched-up detents on said blade.

5. The trowel assembly of claim 1, wherein said rail comprises an axially-extending central channel portion and lateral flanges extending on both sides thereof, said flanges containing said array of openings.

6. The trowel assembly of claim 5, comprising headed screw means extending through said rail into said handle portion to hold together said rail and said handle portion, the headed end of said screw means being located within said channel.

7. The trowel assembly of claim 5, wherein said openings and said spring clips are both arranged in two spaced-apart parallel rows, one row in each of said lateral flanges.

8. The trowel assembly of claim 7, wherein said blade is of spring steel.

9. The trowel assembly of claim 1, wherein said blade is rectangle, and one of the long edges of said blade is bevelled at its two opposite ends.

* * * * *